United States Patent [19]

Curwen

[11] Patent Number: 4,750,871

[45] Date of Patent: Jun. 14, 1988

[54] STABILIZING MEANS FOR FREE PISTON-TYPE LINEAR RESONANT RECIPROCATING MACHINES

[75] Inventor: Peter W. Curwen, Ballson Spa, N.Y.

[73] Assignee: Mechanical Technology Incorporated, Latham, N.Y.

[21] Appl. No.: 24,340

[22] Filed: Mar. 10, 1987

[51] Int. Cl.[4] ..... F04B 1/08; F04B 39/08

[52] U.S. Cl. ..... 417/418; 417/417; 417/520; 417/537

[58] Field of Search ..... 417/416, 417, 418, 534, 417/535, 536, 537, 493, 497, 520; 310/15, 17, 28; 318/122, 123, 124

[56] References Cited

U.S. PATENT DOCUMENTS

| | | | |
|---|---|---|---|
| 1,991,952 | 2/1935 | Murphy | 310/28 X |
| 2,781,461 | 2/1957 | Booth et al. | 310/27 |
| 2,812,893 | 11/1957 | Cotter | 417/493 |
| 2,833,220 | 5/1958 | Robinson et al. | 417/418 |
| 3,004,178 | 10/1961 | Efromson et al. | 310/27 X |
| 3,218,534 | 11/1965 | Casey | 310/17 X |
| 3,359,917 | 12/1967 | Cooprider | 417/520 X |
| 3,891,874 | 6/1975 | Roters et al. | 310/15 X |
| 4,002,935 | 1/1977 | Brauer | 417/418 X |
| 4,311,436 | 1/1982 | Hendriks | 417/45 X |
| 4,345,442 | 8/1982 | Dorman | 417/418 X |
| 4,433,279 | 2/1984 | Bhate | 310/15 X |

*Primary Examiner*—Leonard E. Smith
*Assistant Examiner*—Eugene L. Szczecina, Jr.
*Attorney, Agent, or Firm*—Joseph V. Claeys; Joseph C. Sullivan

[57] ABSTRACT

A resonant reciprocating compressor wherein a reciprocating assembly comprising the movable armature of an electric reciprocating motor and a piston means coupled to the armature is driven cyclically when the electric motor is energized from an alternating current source to compress a working fluid, and including means operatively associated with the reciprocating assembly for producing a stabilizing force gradient in a direction to maintain or restore the reciprocating assembly to a centered operating position.

12 Claims, 7 Drawing Sheets

FIG.6
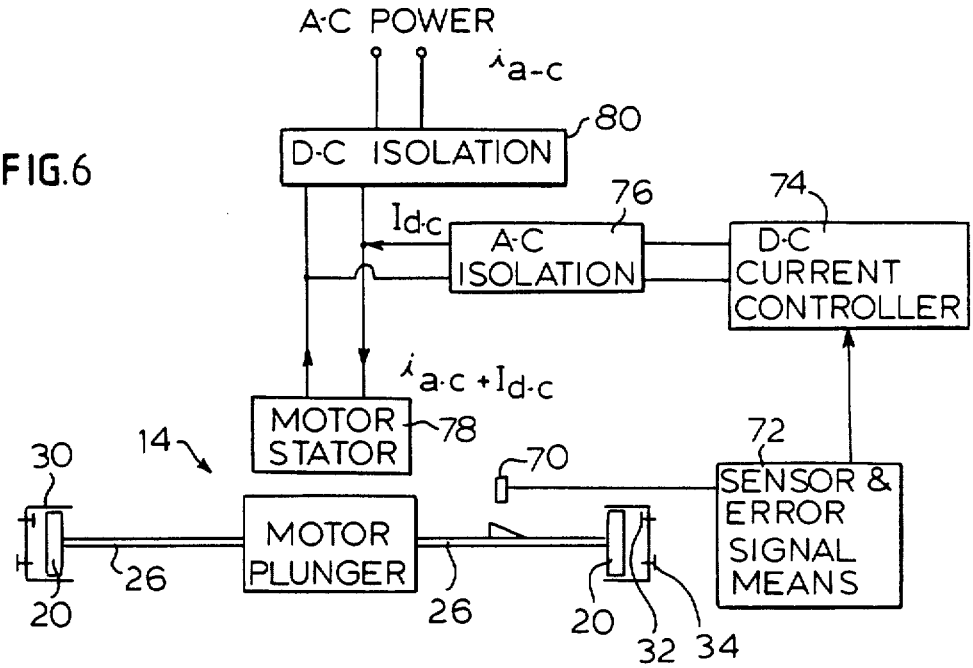
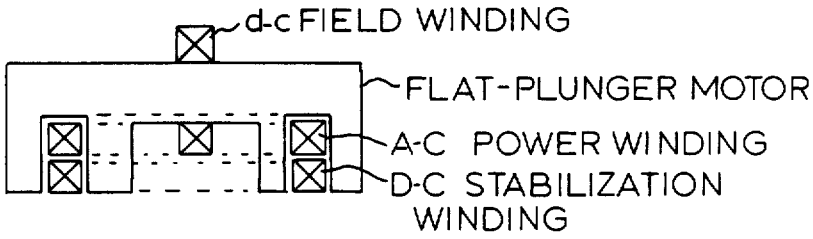
FIG.7

FIG. 9
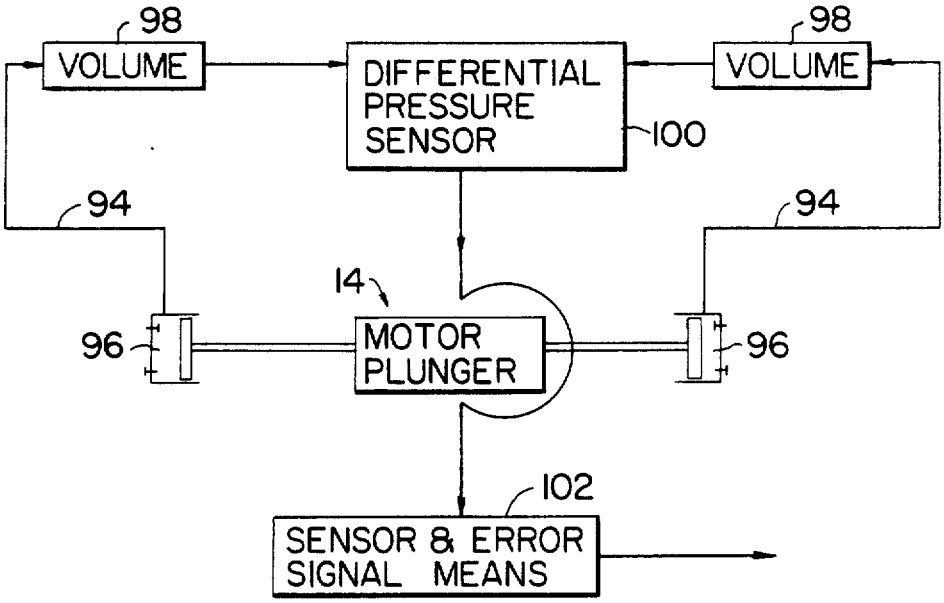
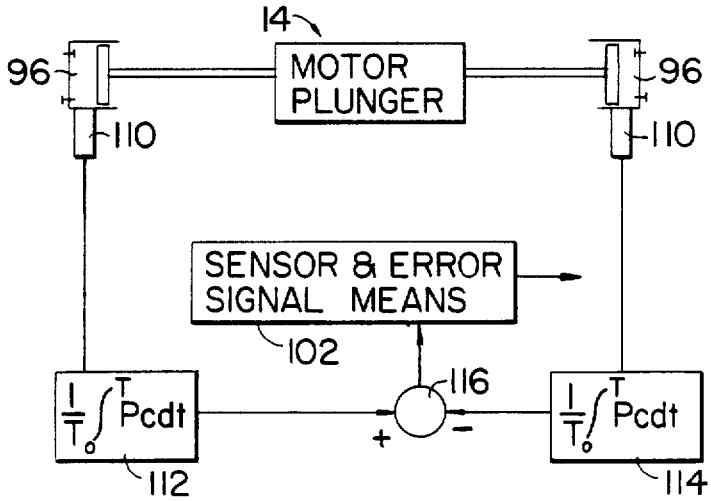
FIG. 10

STABILIZING MEANS FOR FREE PISTON-TYPE LINEAR RESONANT RECIPROCATING MACHINES

TECHNICAL FIELD

The present invention relates to free piston-type linear resonant reciprocating machines such as compressors, pumps and the like, and more particularly to means for stabilizing the mid-stroke operating position of the reciprocating assembly thereof.

BACKGROUND ART

There exists a class of machinery which utilizes mechanical resonance as the means to obtain periodic motion of the machine elements. Reciprocating compressors of this class, often referred to as "resonant piston compressors," can be advantageously used in a variety of applications, such as for example, electrically-driven heat pump systems and the like.

In known free piston-type resonant reciprocating compressors the fluid compressing member, such as a piston, is driven by a suitable motor, such as a linear reciprocating electrodynamic motor. A compression piston is usually coupled to the motor armature and the armature held in a rest position by way of one or more main or resonance spring means. When the motor is energized, such as by an alternating current, a periodic magnetic force is generated to drive the piston. If the frequency of the magnetic force is sufficiently close to the mechanical resonance frequency of the compressor (as determined essentially by the mass of the reciprocating assembly and the combined stiffness of all mechanical and gas-spring components), the piston will oscillate back and forth to provide compression of the fluid.

U.S. Pat. Nos. 3,937,600 to White for a "Controlled Electrodynamic Linear Compressor" and 4,353,220 to Curwen for a "Resonant Piston Compressor Having Improved Stroke Control for Load-Following Electric Heat Pumps and the Like" relate to double-ended two-compressor-cylinder electrodynamic motor-driven resonant reciprocating compressors including gas springs. In such double-ended two-compressor-cylinder arrangements, identical parallel flow cylinders are involved. In principal, these two-compressor-cylinders would undergo the same compression cycle and would be subjected to the same pressure forces so that such design would (in theory) be intrinsically pressure balanced. In practicality, however, such designs are inherently unstable. As long as the two cylinders operate with the same value of mid-stroke volume (or equivalently, at the same clearance volume ratio) then the two cylinders will impose equal but oppositely-directed (cancelling) average pressure forces on the plunger-driven pistons. However, any slight offset bias of the plunger from the theoretical center position causes the average pressure forces on the two pistons to be unbalanced in such a way that it tends to push the plunger further off center, resulting in an axially unstable arrangement. To solve such a situation, these patents introduce ports on the gas springs. When the piston begins to go off center, an opposing average pressure force which is larger than the destabilizing force coming from the cylinder would be generated resulting in a stable operating center position.

Mechanical springs can be used for centering and axial stabilization but this increases weight, and unless the operating stroke is kept short can decrease the operating life due to spring fatigue.

In the ideal form, a free-piston-type resonant reciprocating machine has no mechanical connection between the reciprocating and stationary assemblies. Accordingly, prior to start-up the reciprocating assembly may be located anywhere between the mechanical overstroke limits, unless some special means is provided to lock the assembly at or close to its mid-stroke position. If no such means is provided, and if the axis of the reciprocating assembly is parallel to the earth's gravity axis, the reciprocating assembly will always be resting at the lower mechanical limit stop prior to start-up.

In general, a linear electric drive motor can often be employed which can produce a strong enough electromagnetic or electrodynamic centering force to bring the reciprocating assembly to the center position at start-up. This is often the most desirable solution to the start-up centering situation.

Use of mechanical centering springs can also be employed to solve the centering problem. Since the same mechanical spring means can also provide a means for achieving axial stability, such an approach is attractive. One major problem with mechanical springs, however, is that in order to obtain reasonable operating life the operating stroke must be kept small. That is, the problem of spring fatigue life always results in a restriction on the maximum operating stroke which can be used for the compressor and motor system. At short stroke operation there are severe combined penalties of motor cost, weight, size and efficiency.

While the arrangements of U.S. Pat. Nos. 3,973,600 and 4,353,220 have proved eminently satisfactory in the two-compressor-cylinder arrangement it is desirable to avoid the use of gas springs, since they introduce undesirable losses and contribute to increased manufacturing cost. It is desirable that further work be carried out to reduce the cost, weight, size, and to increase the efficiency of such machines.

DISCLOSURE OF INVENTION

It is an object of this invention to provide for an improved free-piston-type resonant reciprocating compressor which has a controlled and efficient operating stroke.

It is another object of this invention to provide for axial positioning stability in a linear electrodynamic motor-driven resonant reciprocating compressor.

It is another object of this invention to provide a free-piston-type resonant reciprocating compressor which eliminates or minimizes the combined penalties usually associated with centering and stabilizing means employing mechanical springs.

It is another object of the invention to provide a new and improved means for providing axial stabilization of free-piston-type linear resonant reciprocating machines.

It is another object of this invention to provide a pneumatic means for producing a force gradient to achieve axial stabilization in free-piston resonant reciprocating compressors.

It is still another object of this invention to provide an electrical means for producing a force gradient to achieve axial stabilization in free-piston reciprocating machines.

BRIEF DESCRIPTION OF THE DRAWINGS

The aforenoted objects and advantages and others will be realized by the present invention, the description of which should be taken in conjunction with the drawings wherein:

FIG. 6 is a schematic diagram of an embodiment of the electric stabilizing means of this invention;

FIG. 7 is a schematic view of the stator region of an electrodynamic motor illustrating a means of obtaining D-C and A-C isolation for the stabilizing means of FIG. 6;

FIG. 9 is a schematic diagram of another embodiment of the electric stabilizing means in accordance with the teachings of this invention.

FIG. 10 is a schematic diagram of still another embodiment of an electrical stabilizing means in accordance with the invention.

BEST MODE FOR CARRYING OUT THE INVENTION

Figure 1:
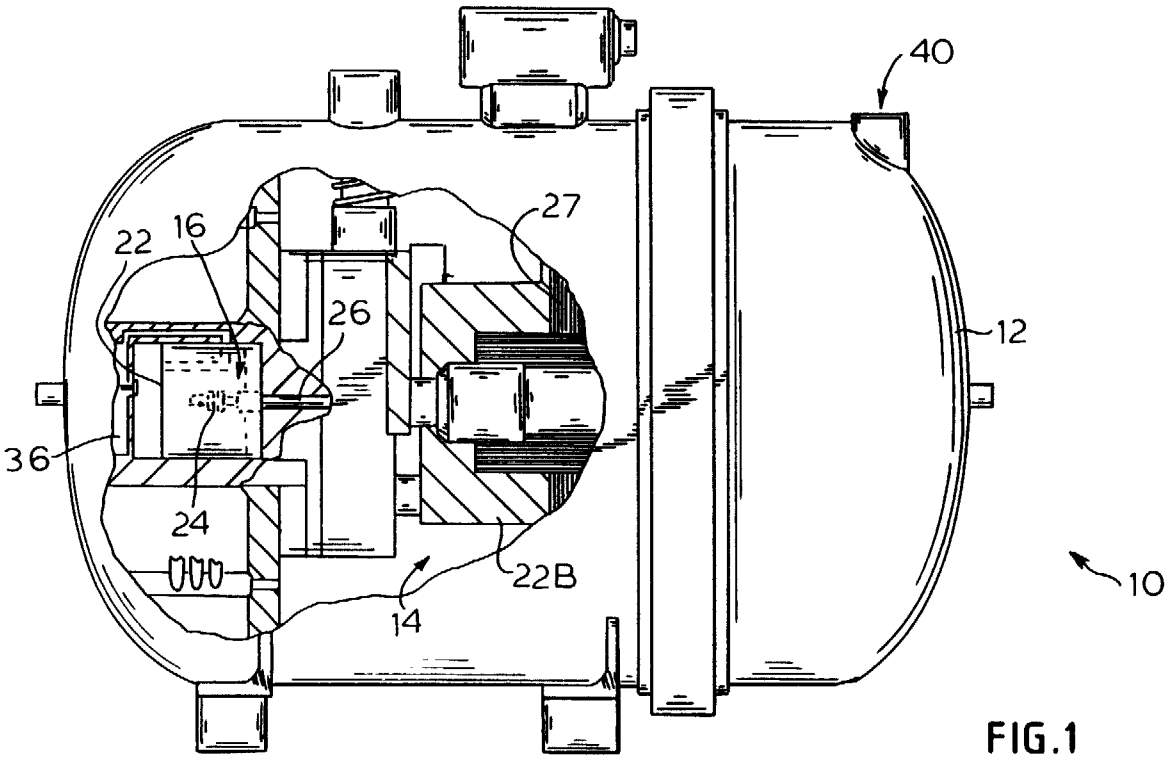
FIG. 1 is a partial sectional view of a two-compressor-cylinder free-piston-type resonant reciprocating compressor in accordance with the teachings of the present invention.
Figure 2:
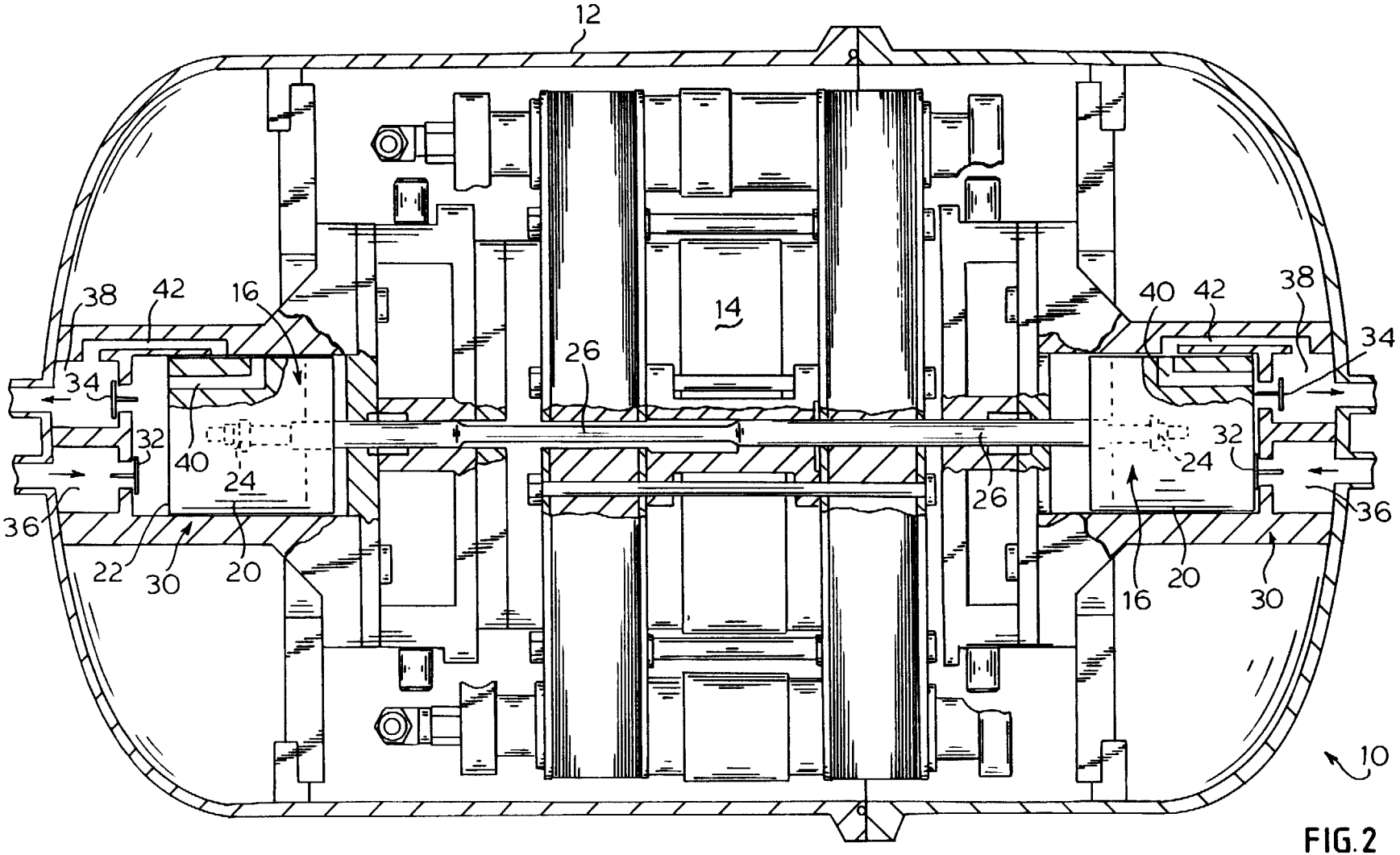
FIG. 2 is a detailed, partial sectional view of the two-compressor-cylinder resonant reciprocating compressor incorporating the teachings of the present invention.

In the compressor illustrated and described in detail herein there are two pistons mechanically joined together such that both pistons undergo the same axial displacements. That is, the invention is illustrated and described for a two opposed single-acting cylinder machine. It should be understood, however, that the invention may be incorporated as well in a single cylinder machine which employs a double-acting piston to produce fluid compression cycles on both ends of the piston.

With more particular regard to the drawings, there is shown a compressor 10. The compressor 10 includes an outer housing 12 which is cylindrical in shape containing a flat plunger-type electrodynamic motor, generally indicated at 14, coupled to compression piston assemblies 16 at each end.

The present invention provides for an improved electrodynamic linear-motor-driven reciprocating machine, such as a compressor, pump, or the like. Although any suitable reciprocating motor may be used, it is preferred to employ an electrodynamic linear motor of the type described in U.S. patent application Ser. No. 024,242, filed Mar. 10, 1987 and entitled, "Flat Plunger Linear Electrodynamic Machine," in the name of Peter W. Curwen and Ralph Hurst, and assigned to Mechanical Technology Incorporated, the same assignee as the present invention.

The electrodynamic motor of that application has a lightweight flat plunger which significantly reduces the amount of resonance spring required. The plunger assembly is formed from alternate layers of magnetic and insulating strips clamped together with suitable tie rods and maintained on respective guide shafts which reciprocate on guide members within the gap between stator members. One end of the motor plunger is coupled to a compression piston and a centering or resonance spring may be provided at the opposite end. Depending on the application and the magnitude of the magnetic centering force provided by the motor, such centering spring may sometimes be eliminated.

Positioned about and spaced from the plunger core is a motor stator assembly which is mounted to the housing. The application of current to the stator windings causes a driving force on the plunger core which in turn drives the piston for compression of the working fluid. The piston is ported to maintain centered operation of the piston-motor plunger stroke relative to the cylinder and motor-stator assemblies.

In operation, when an alternating current is applied to the motor its magnetic plunger is caused to drive the compression piston in a first direction compressing the working fluid (such as air, helium, etc.). The current then alternates so that the plunger oscillates and returns to its center position due to the reversed driving force by the stator and/or a centering spring. The motor operates typically at the frequency of the local A-C power source (on the order of 60 Hertz in the U.S. and 50 Hertz in some foreign countries) continuously compressing the working fluid.

Compression piston assemblies 16 each comprise a hollow cylindrical piston member 20 having a closed end 22 which is mechanically affixed at 24 to one end of rod 26, which in turn is connected to the plunger of motor 14. The piston member 20 is positioned in a cylindrical cylinder housing 30 which includes suction valve means 32 which communicates with a suction manifold 36. Cylinder 30 also includes a discharge valve means 34 which communicates with a discharge manifold 38.

As shown in the drawings the two pistons are connected at opposite ends of the rod 26 of the motor 14. The two pistons thus undergo the same axial displacements. The assembly of the plunger means of the motor 14 and the piston assemblies 16 comprise the reciprocating assembly of the compressor.

The discharge manifolds may be arranged in any suitable manner, such that the average pressure in each manifold is substantially the same. Conveniently, the two discharge manifolds 38 are connected together through a common plenum in housing 12.

The resonant free piston compressor is not a fixed stroke machine as is the case with crank or cam driven piston compressors. Rather, its stroke is infinitely variable from zero up to the maximum permitted by the mechanical overstroke stops. At any particular instant, the stroke will be a function of (1) the compressor power load and parasitic losses, (2) the force being developed by the motor, and (3) the state of resonant tuning. These three factors are not independent; they are all coupled together through the electro-pneumatic-mechanical interactions of the resonant compressor system.

As a consequence of the non-fixed stroke, there may be regions of steady-state and/or transient compressor operation where the reciprocating assembly may reach the overstroke limits of the design and begin contacting the mechanical stops. This mode of operation may produce undesirable noise and/or damage if allowed to persist.

As previously stated, the foregoing compressor is inherently unstable. The present invention provides means for correcting this problem.

Figure 3:
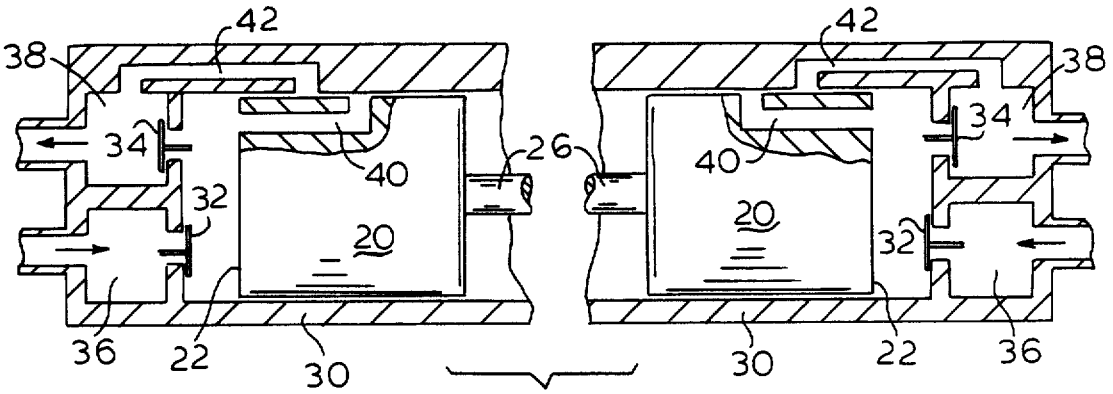
FIGS. 3 and 3A are schematic views of a two opposed single acting piston-cylinder arrangement of a free-piston resonant reciprocating compressor of FIG. 1 illustrating the operation of the pneumatic stabilizing means in accordance with this invention.
Figure 3A:
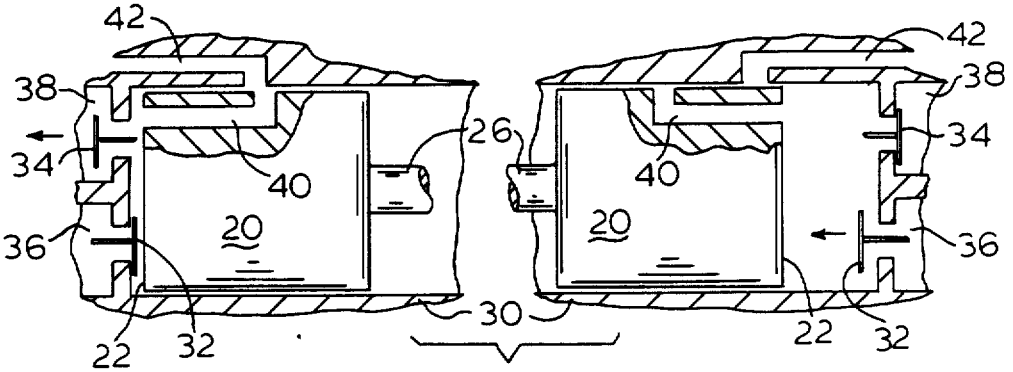

In FIGS. 3 and 3A, there is shown one embodiment of a simple pneumatic means for providing the desired stabilization. FIG. 3 illustrates the pistons 20 in the mid-stroke (center) position while FIG. 3A illustrates the pistons in the left-most position.

As shown in FIGS. 3 and 3A, the stabilization is provided by a simple porting arrangement. Piston members 20 are provided with a port 40 which extends from a point on the piston wall through piston head 22. The cylinders 30 are provided with ports 42 which extend axially from the discharge manifold 38 to a point in the wall of cylinder 30.

Figure 11:
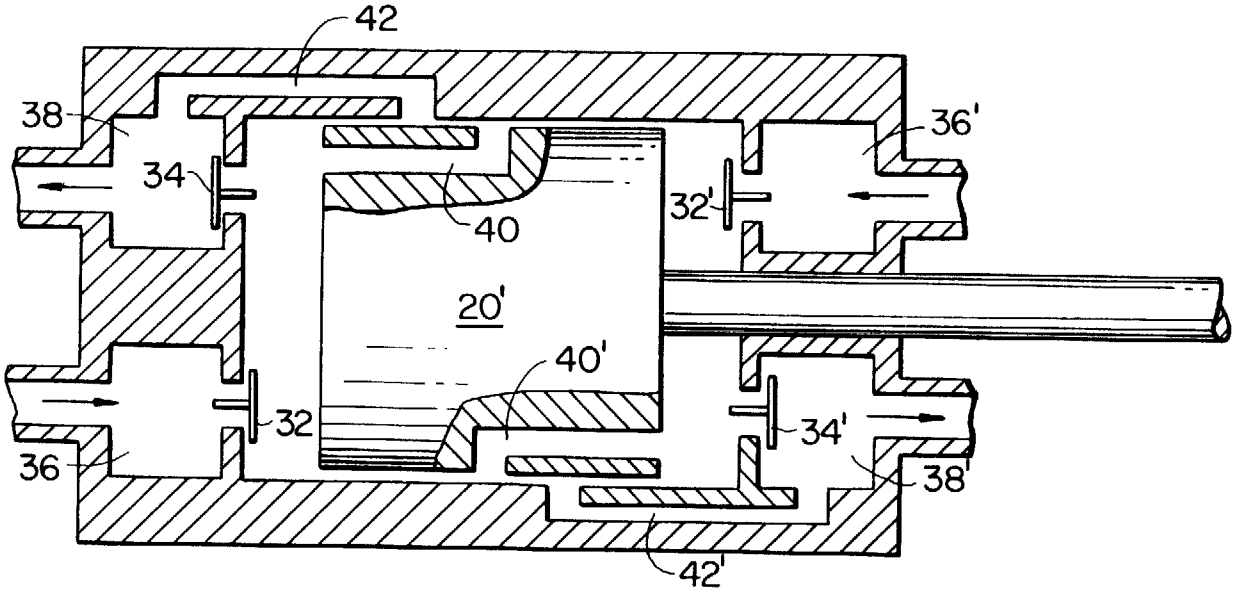
FIG. 11 is a schematic view of the pneumatic stabilizing means of this invention in a single-cylinder, double-acting piston arrangement.

In FIG. 11 the stabilizing means is shown in a single-cylinder, double-acting piston arrangement.

The foregoing stabilizing means operates in the following manner.

During centered operation of the reciprocating assembly, the piston and cylinder wall ports in each cylinder (40 and 42, respectively) either do not directly communicate at all, or do so only briefly as each piston traverses its top dead center (TDC) position. Now assume that the reciprocating assembly is somehow perturbed to reciprocate about some off-center position, say some position to the left of the centered position such that cylinder number 1 (left) operates at a smaller clearance volume ratio (CVR), and cylinder number 2 (right) operates at a larger CVR relative to their CVR values at the centered position (which would be the same for both cylinders). In the off-center (to the left) position, the ports in the number 1 cylinder will begin to communicate (or will communicate for a longer period of time and with a larger differential pressure after TDC) as contrasted to the situation when the reciprocating assembly was operating about the centered position. At the same time, the ports in the number 2 cylinder will not be communicating (or will communicate for a shorter period of time and with a smaller differential pressure after TDC) relative to the centered situation. The result of this nonsymmetric porting action during off-center operation will be to increase the average pressure of cylinder number 1 relative to the average pressure of cylinder number 2. As a consequence, an axial resultant average pressure force will be generated by the two cylinders which acts in the direction to push the reciprocating assembly back towards the centered position. This is the desired stabilizing action. Without the porting action, the resultant axial average pressure force from the two cylinders would act in the opposite direction, acting to further increase the amount of off-centeredness, giving rise to the undesirable destabilizing action.

Figure 4:
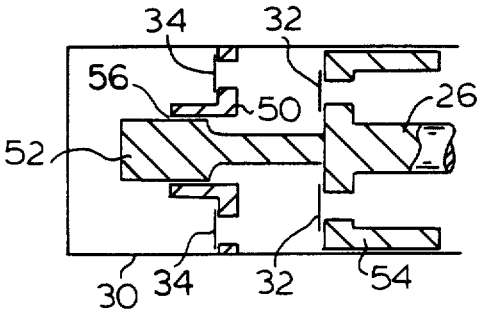
FIG. 4 is a schematic view of a piston-cylinder arrangement illustrating another embodiment of the pneumatic stabilizing means of this invention.

FIG. 4 illustrates another embodiment of a pneumatic means for providing stabilization. As shown the porting function has been moved from the cylinder well, as in FIGS. 3 and 3A, to the cylinder head 50. A porting plug 52 connected to the head of piston member 54 reciprocates within the opening 56 of the cylinder head 50. This arrangement eliminates one of the leakage paths from the discharge manifold to the cylinder which exists in the arrangement of FIG. 3.

Figure 5:
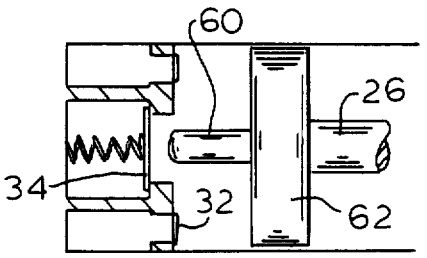
FIGS. 5 and 5A are schematic views of a piston-cylinder arrangement illustrating another embodiment of the pneumatic stabilizing means of this invention.
Figure 5A:
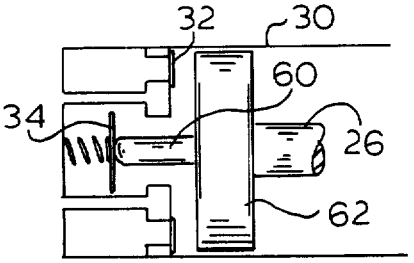

In FIGS. 5 and 5A a piston pin 60 extends from the head of the piston 62. The discharge valve 34 opens normally under action of the differential pressure across the valve as the piston approaches TDC. The valve opens due to the $\Delta p$ well in advance of any contact between the piston pin and the valve plate. However, the piston pin prevents a normal closing of the valve such as would occur when the $\Delta p \rightarrow 0$. The pin holds the valve open until the piston has moved some distance past TDC (towards BDC) at which point the valve has been returned to its normally closed position on the valve plate and pin 60 disengages from contact with the valve. During the brief post-TDC interval when the pin 60 is holding the valve open, backflow from the discharge manifold to the cylinder occurs. This backflow creates a delay in initiation of the expansion process in that cylinder such that the average pressure from top dead center to the end of expansion is greater in such cylinder than it is in the other cylinder.

The FIG. 5 arrangement has the advantage that all leakage paths are eliminated and manufacturing tolerances are less critical. With this arrangement proper design consideration must be given to assure that impact damage does not occur at the point of contact between the valve plate and the piston pin.

Electrodynamic linear motors are known which will produce a D-C component of axial air gap force if a D-C component of current is present in the A-C power windings. Furthermore, the direction of the D-C force component depends on the direction of the D-C current flow. If the D-C current is reversed, the direction of the D-C force will reverse. In accordance with another embodiment of this invention, the linear motor is utilized to provide the desired axial stabilization of the reciprocating assembly of the machine. The essence of the concept involves sensing a selected operating parameter of the compressor, such as the direction of off center drift of the reciprocating assembly, or the difference in average pressure, and using this signal to generate a D-C current of the correct polarity to produce a D-C component of motor air-gap force acting in the direction to restore the reciprocating assembly to, or close to, its centered position.

One approach utilizing the linear electrodynamic motor to provide the required stabilization is shown in FIG. 6. As shown, a sensor 70 is provided to sense the position of the piston. The signal from position sensor 70 is applied to a sensor and error signal electronics means 72, the output of which is applied to a direct current controller 74. The controller 74 is connected through a suitable A-C isolation means 76 to the windings of the motor stator 78, and also through a direct current isolation means 80 to the A-C power source.

An alternate means of obtaining the necessary D-C and A-C isolation is to employ a separate D-C stabilization winding adjacent to the A-C winding on the motor stator 78 as shown, for example, in FIG. 7.

Another arrangement for generating the direct current component in the A-C power winding is to modify the waveform of the A-C current such that the average value of the waveform over a complete cycle is not zero (as it normally would be with straight A-C utility power applied to the windings). Various types of A-C current waveform modifications are possible: (1) variable duty-cycle control of the positive and/or negative portions of the current at a fundamental frequency corresponding to the A-C utility frequency; (2) amplitude control of the positive and/or negative portions of the current, again at the fundamental frequency of the utility power; and (3) high frequency chopping and waveform reconstruction techniques.

Figure 8:
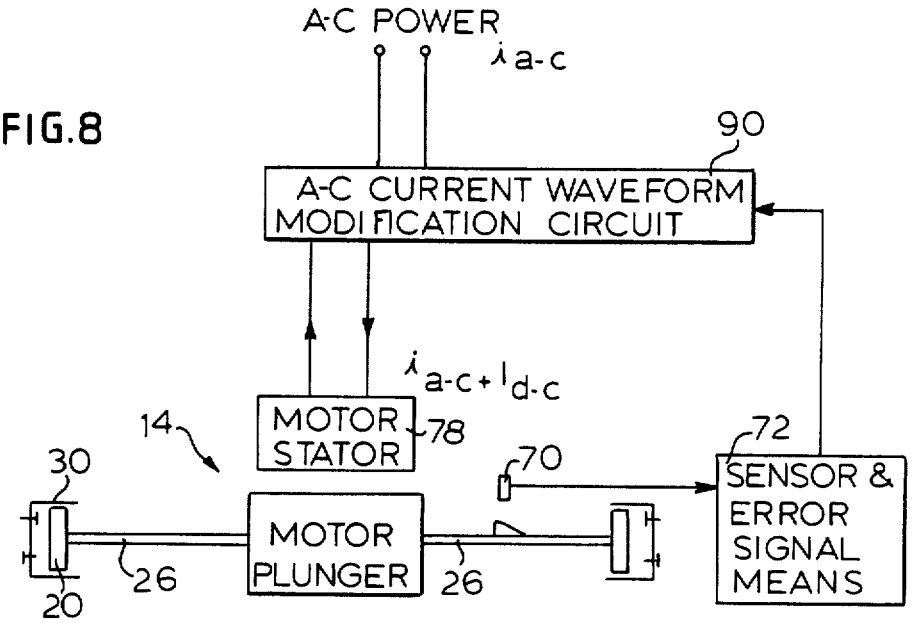
FIG. 8 is a schematic diagram illustrating another arrangement for obtaining the D-C component of the A-C current in accordance with another embodiment of the electric stabilizing means of this invention.

FIG. 8 is a schematic diagram of one arrangement for obtaining the D-C current component in the A-C winding by such a waveform modification. As shown, the signal from position sensor 70 is applied to sensor and error signal electronics means 72, the output of which is applied to A-C current waveform modification means 90. The A-C current waveform modification means 90 is connected to the A-C power source and also to the windings of the motor stator 78.

In FIG. 9 there is shown a schematic diagram of another embodiment of the invention wherein the parameter being sensed is the difference in average pressures in the two compression cylinders. For example, it is this difference in average pressures which causes the reciprocating assembly to drift.

In FIG. 9 pressure tap lines 94 are provided to each of the compression volumes 96 of the compressor. Tap lines 94 are connected through suitable pneumatic filters 98 to a differential pressure sensor 100, which in turn is connected to a suitable sensor and error signal electronics means 102.

FIG. 9 also schematically illustrates in phantom an arrangement which employs means for electronically producing signals representing the average pressure of each compression cylinder. As shown, each cylinder is provided with a suitable dynamic pressure transducer means 110. Dynamic pressure transducers 110 provide an electrical signal output proportional to the cylinder pressure. The arrangement also includes means for computing the average pressure of each cylinder, which may be by either electronic analog or digital computation circuit means. As shown in FIG. 10 this computation is provided by suitable integration circuit means 112 and 114. The output signals from integration circuit means 112 and 114 are applied to summing means 116, the output of which is applied to the sensor and error signal electronic means 102, the output of which would be applied to a suitable circuit means such as D-C current controller 74 or a current waveform modification circuit 90.

Although only certain specific embodiments of the invention have been described in detail herein with reference where suitable to the accompanying drawing, it is to be understood that the invention is not limited to those specific embodiments and that various changes and modifications will occur to and be made by those skilled in the art. The appended claims, therefore, are intended to cover all such changes and modifications as fall within the true spirit and scope of the invention.

What is claimed is:

1. A resonant reciprocating compressor, comprising:

a compressor housing having fluid intake and discharge passage means;

an electric reciprocating motor having a movable armature, said motor disposed within said compressor housing and adapted to be driven cyclically when said motor is energized from an A-C power source and substantially in accordance with the frequency of the A-C power source;

cylinder means disposed within said housing;

intake and discharge valve means operatively associated with said cylinder means and with respective intake and discharge passage means, said discharge passage means being arranged such that the average pressure in each discharge passage means is substantially the same;

piston means disposed within said cylinder means, said piston means coupled to and forming a reciprocating assembly with said motor armature and being operative to compress a working fluid therein; said cylinder means and said piston means being arranged and constructed in a two opposed single-acting cylinder configuration; and means operatively associated with said reciprocating assembly for producing a stabilizing force gradient in a direction to restore the reciprocating assembly assembly to the centered position including port means separate from said discharge passage means for communicating the compressor discharge pressure to the compressor cylinders during some portion of the stroke of the reciprocating assembly.

2. The resonant reciprocating compressor in accordance with claim 1, wherein said port means includes a port in each piston and a port in the wall of each cylinder.

3. The resonant reciprocating compressor in accordance with claim 1, wherein said port means comprises a porting plug which reciprocates within an open cylinder in the head of said cylinder.

4. The resonant reciprocating compressor in accordance with claim 1, wherein said port means includes means for introducing a predetermined delay in the closing of the discharge valve means.

5. A resonant reciprocating compressor, comprising:

a compressor housing having fluid intake and discharge passage means;

an electric reciprocating motor having a movable armature, said motor disposed within said compressor housing and adapted to be driven cyclically when said motor is energized from an A-C power source and substantially in accordance with the frequency of the A-C power source;

cylinder means disposed within said housing;

intake and discharge valve means operatively associated with said cylinder means and with respective intake and discharge passage means said discharge passage means being arranged such that the overall pressure in each discharge passage means is substantially the same;

piston means disposed within said cylinder means, said piston means coupled to and forming a reciprocating assembly with said motor armature and being operative to compress a working fluid therein said cylinder means and said piston means being arranged and constructed in a single-cylinder double-acting piston configuration and the discharge passage means are arranged such that the average pressure in the discharge passage means is substantially the same; and means operatively associated with said reciprocating assembly for producing a stabilizing force gradient in a direction to restore the reciprocating assembly to the centered position including port means separate from said discharge passage means for communicating the compressor discharge pressure to the compressor cylinder during some portion of the stroke of the reciprocating assembly.

6. The resonant reciprocating compressor in accordance with claim 5, wherein said means for producing a stabilizing gradient in a direction to restore the reciprocating assembly to the centered position comprises porting means for communicating the compressor discharge pressure to the compressor cylinders during some portion of the stroke of the reciprocating assembly.

7. A resonant reciprocating compressor, comprising:

a compressor housing having fluid intake and discharge passage means;

an electric reciprocating motor having a movable armature, said motor disposed within said compressor housing and adapted to be driven cyclically when said motor is energized from an A-C power source and substantially in accordance with the frequency of the A-C power source;

cylinder means disposed within said housing;

intake and discharge valve means operatively associated with said cylinder means and with respective intake and discharge passage means;

piston means disposed within said cylinder means, said piston means coupled to and forming a reciprocating assembly with said motor armature and being operative to compress a working fluid therein; and means operatively associated with said reciprocating assembly for producing a stabilizing force gradient including means for sensing an operating parameter of said compressor and supplying a direct current component to A-C windings of the motor to produce an average component of axial air gap force having a direction to restore the reciprocating assembly to the centered position.

8. The reciprocating compressor in accordance with claim 7, wherein the direct current component of axial air gap force is produced by a separate direct current winding disposed adjacent the A-C windings.

9. The resonant reciprocating compressor in accordance with claim 7, including means for sensing the axial position of said reciprocating assembly.

10. The resonant reciprocating compressor in accordance with claim 7, including means for determining the difference in average pressure in the compression cylinders.

11. The reciprocating compressor in accordance with claim 10, wherein said means for determining the difference in average pressure in the compression cylinders includes means for sensing the pressure in each cylinder and applying said pressure signals to a differential pressure sensor means.

12. The reciprocating compressor in accordance with claim 10, wherein said means for determining the average pressure in the compression cylinders includes sensing means operatively associated with each compression cylinder for producing an electrical output signal proportional to cylinder pressure, and means responsive to said electrical output signals from said sensing means for computing the average pressure of each cylinder.

* * * * *